US006382406B1

(12) United States Patent
Corbasson

(10) Patent No.: US 6,382,406 B1
(45) Date of Patent: May 7, 2002

(54) EYEGLASS LENS DISPLAY UNIT

(75) Inventor: Frederic Corbasson, Dallas, TX (US)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 0 days.

(21) Appl. No.: 09/617,498

(22) Filed: Jul. 17, 2000

(51) Int. Cl.[7] ..... A45C 11/04
(52) U.S. Cl. ..... 206/5; 206/303
(58) Field of Search ..... 206/5, 6, 303, 206/316.1, 747, 445, 759

(56) References Cited

U.S. PATENT DOCUMENTS

| | | | | |
|---|---|---|---|---|
| 1,547,142 A | | 7/1925 | Bausch | |
| 5,467,869 A | | 11/1995 | Elie et al. | |
| 5,615,765 A | * | 4/1997 | Roericht | 206/6 |
| D431,905 S | * | 10/2000 | McCormack | D3/201 |

* cited by examiner

*Primary Examiner*—Shian T. Luong
(74) *Attorney, Agent, or Firm*—Young & Thompson

(57) ABSTRACT

An eyeglass lens display unit comprises at least two branches for supporting at least two different eyeglass lens portions. The two branches are mobile relative to each other to position the eyeglass lens portions edge-to-edge along their diameter.

11 Claims, 1 Drawing Sheet

EYEGLASS LENS DISPLAY UNIT

BACKGROUND OF THE INVENTION

1. Field of the Invention

The present invention concerns an eyeglass lens display unit for use by an optometrist.

2. Description of the Prior Art

For displaying eyeglass lenses, optometrists currently use lorgnettes which comprise a circular frame accommodating an eyeglass lens and are usually pivotally mounted on a display plate.

U.S. Pat. No. 1,547,142 describes one embodiment of a lorgnette of the above kind.

U.S. Pat. No. 5,467,869 discloses an eyeglass lens display case which includes a plate adapted to receive an eyeglass lens to be displayed and two half-shells which are pivotally mounted at the edge of the plate and each of which can move between a closed position in which they conjointly form a protective shell for the plate and an open position in which they uncover it.

The major disadvantage of such display units is that they can display only one eyeglass lens at a time.

There already exists a display lens for demonstrating the effectiveness of anti-reflection treatment of an eyeglass lens in which only the center of the display lens has received the anti-reflection treatment.

Finally, there is already known in the art a plane display unit with slots into which various eyeglass lenses cut in half along a diameter are inserted.

However, with a plane display unit of the above kind, it is complicated to compare two different lenses because this requires the lenses to be manipulated, in particular extracted from the display unit.

A display unit of the above kind is also relatively bulky and impractical.

SUMMARY OF THE INVENTION

To overcome the above drawbacks, the present invention proposes a new eyeglass lens display unit comprising at least two branches for supporting at least two different eyeglass lens portions, which branches are mobile relative to each other to position the eyeglass lens portions edge-to-edge along their diameter.

Accordingly, thanks to the display unit according to the invention, an optometrist can easily:

demonstrate the effectiveness of an anti-reflection treatment on one lens portion;

show the difference between the curvatures of the lens portions displayed;

show the difference between the thicknesses of the lens portions displayed; and show the aspherical nature of the lens portions displayed.

Other advantageous and non-limiting features of the display unit according to the invention are as follows:

the branches are mounted on a plate whose surface facing said branches is adapted to absorb light; this surface is preferably matt black; this shows up better the difference between a lens that has received an anti-reflection treatment and one that has not;

the plate has a flat on its edge, each branch has a flat on the outside edge of its free end and said two flats of said branches when aligned form a single flat parallel to that of said plate and enable said display unit to be placed vertically on a support; a display unit of this kind therefore takes up little room on the desk of an optometrist when positioned vertically;

the branches are articulated to each other by means of a pivot whose axis is perpendicular to the plane containing the branches; in one embodiment of the invention the branches are nested one within the other at one end and the nested ends of said branches incorporate holes for mounting them on the pivot, which can comprise a screw passing through the aligned holes in the branches and screwed into a threaded bush; the branches are easy to handle when articulated in this manner; and the branches are semicircular.

The following description, which is given with reference to the accompanying drawings, which are provided by way of non-limiting example only, explains the invention and how it can be put into practice.

DETAILED DESCRIPTION OF THE PREFERRED EMBODIMENT

FIGS. 1 to 4 show a display unit 100 for eyeglass lenses A, B.

The display unit 100 has two branches 110, 120, each of them is advantageously semicircular.

The branches 110, 120 are adapted to support two different eyeglass half-lenses B, A at their inside edge 114, 124.

In the present context the expression "eyeglass lens" means the circular contour blank that an eyeglass lens constitutes before it is trimmed to the contour of the rim or surround of an eyeglass frame to which it must be fitted.

Figure 1:
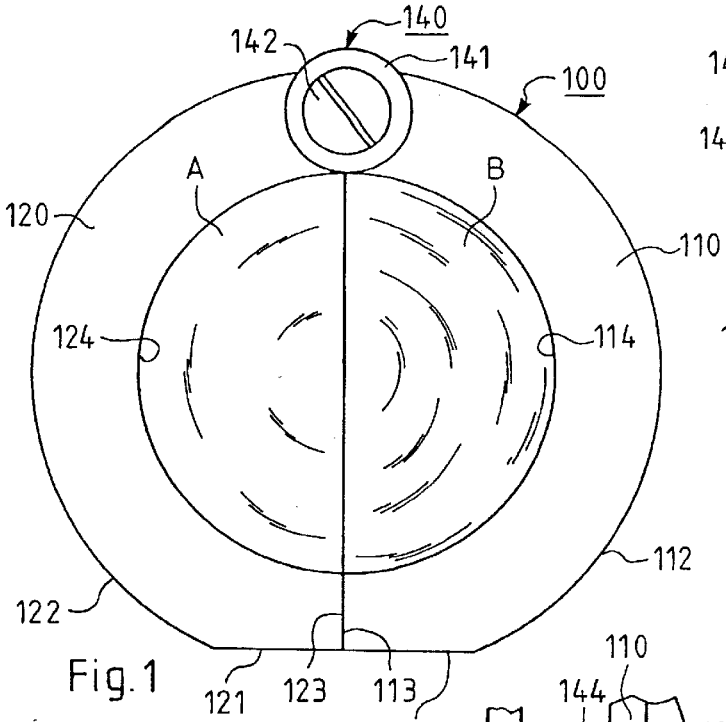
FIGS. 1 and 4 are diagrammatic views of a display unit according to the invention in its closed and open configurations, respectively.
Figure 4:
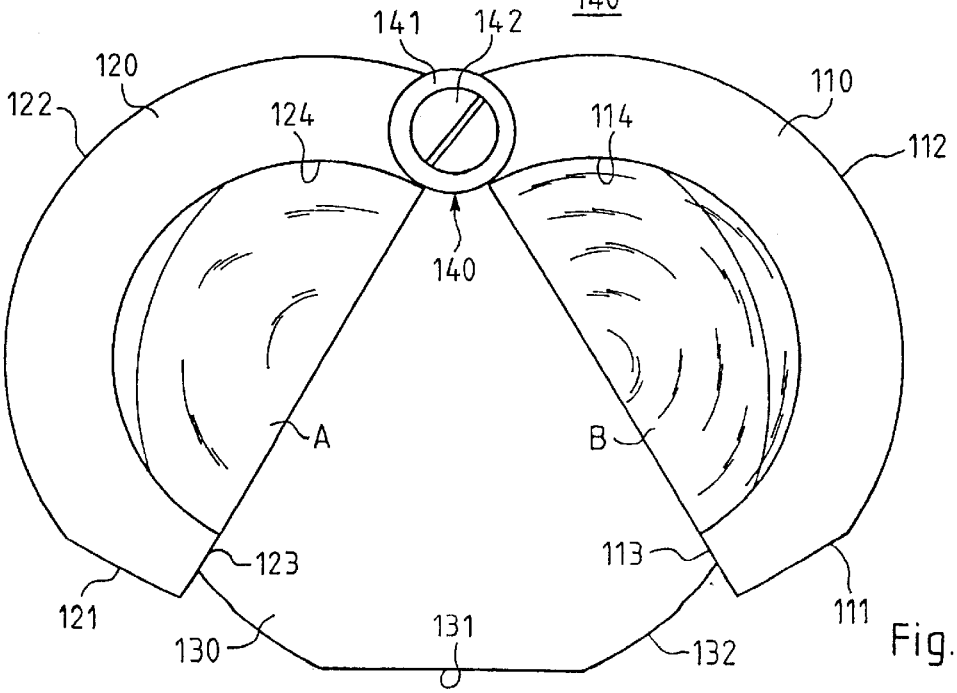

The branches 110, 120 are mobile relative to each other for positioning the eyeglass half-lenses B, A edge-to-edge along their diameter (see FIGS. 1 and 4).

The branches 110, 120 are articulated to each other by means of a pivot 140 whose axis is perpendicular to the plane containing the branches 110, 120.

The branches 110, 120 are mounted by means of the pivot 140 on a plate 130 whose surface facing the branches 110, 120 is adapted to absorb light.

This surface of the plate 130 is preferably matt black.

The plate 130 takes the general form of a disk whose diameter corresponds to the diameter of the circle formed by the two branches 110, 120 in the closed position with their two free ends 113, 123 edge-to-edge (FIG. 1).

The plate 130 has a flat 131 on its edge 132 opposite the pivot 140 and each branch 110, 120 has a flat 111, 121 on the edge 112, 122 of its free end 113, 123.

The aligned flats 111, 121 of the two branches 110, 120 when brought together form a single flat parallel to and substantially the same length as the flat 131 of the plate 130.

Figure 2:
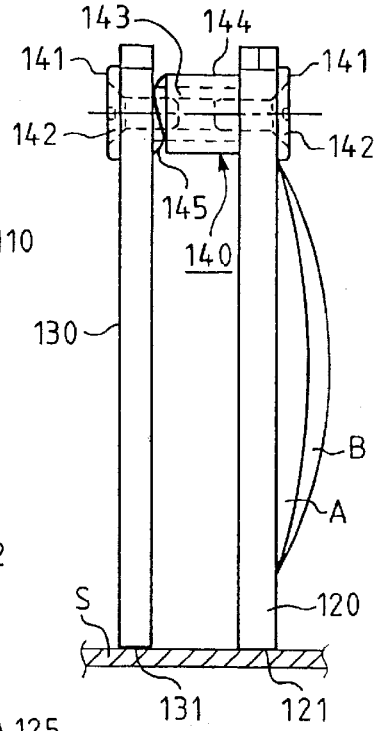
FIG. 2 is a side view of the display unit according to the invention placed vertically on a support.

As shown in FIG. 2 in particular, the flats 131, 111, 121 formed on the edge 132 of the plate 130 and the edges 112, 122 of the branches 110, 120 enable the display unit 100 to be placed vertically on a support S.

Figure 3:
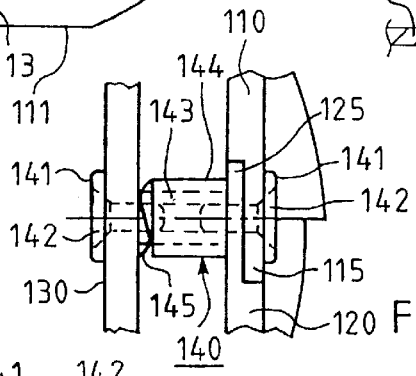
FIG. 3 is a partial plan view of the display unit shown in FIG. 1.

As shown in FIG. 3 in particular, the ends 115, 125 of the branches 110, 120 opposite their free ends 113, 123 are nested one within the other. Holes are formed in the nested ends 115, 125 to enable them to be mounted on the pivot 140.

The pivot 140 comprises a screwthreaded bush 143 disposed between the plate 130 and the branches 110, 120 and into which screws 142 are screwed. One of the screws 142 passes through the superposed holes in the branches 110, 120 and the other screw 142 passes through a hole in the plate 130.

The heads of the screws 142 bear on washers 141 resting on the outside faces of the branches 110, 120 and the plate 130.

One end of a cylindrical sleeve 144 around the screwthreaded bush 143 bears on the inside face of the branches 110, 120. Its other end bears on a spring washer 145 resting on the surface of the plate 130 facing the branches 110, 120. The spring washer 145 compensates assembly clearances to avoid slack where the two branches 110, 120 are articulated to each other.

The two branches 110, 120 can advantageously be made from a translucent material and can have information concerning the lenses they carry on their outside face, which faces the user.

As shown in FIG. 2 in particular, the display unit 100 according to the invention can be used to show the difference in thickness between the two lenses A and B. In particular the lens portion B can be seen to be thicker than the lens portion A.

The display unit 100 also enables the difference in sphericity between the lenses to be shown. In the typical situation illustrated, the lens portion A is aspherical and the lens portion B is spherical.

The matt black surface of the plate 130 behind the lenses carried by the support branches 110, 120 of the display unit 100 enables the differences between anti-reflection treatments of the two lenses to be shown.

In particular, the lens portion A has an anti-reflection treatment and the lens portion B has none.

A display unit 100 of the above kind is compact and easy to handle and takes up little room on the desk of an optometrist because it can stand upright on the desk on its flats 131, 111, 121.

Finally, the two branches 110, 120 of the display unit enable the lens portions A, B displayed to be handled easily.

The present invention is in no way limited to the embodiment described and shown and the skilled person will know how to make many modifications thereto conforming to the spirit of the invention.

In particular, each branch of the display unit can support more than one lens portion, for example two lens portions each representing a quarter-lens, so that pairs of lens portions can be displayed, two-by-two, meeting along their diameter.

Also, the branches of the display unit can have a shape other than semicircular, for example a U-shape or an L-shape.

Finally, the branches can slide relative to each other instead of being articulated by means of a pivot.

What is claimed is:

1. An eyeglass lens display unit comprising at least two flat branches, one of said branches supporting at least one eyeglass lens portion and another one of said branches supporting at least another different eyeglass lens portion, said branches are movable relative to each other to position said eyeglass lens portions edge-to-edge along respective lens diameters.

2. The display unit claimed in claim 1, wherein said support is a plate, a surface of said plate facing said branches.

3. The display unit claimed in claim 2, further comprising a flat portion on an edge of said plate, each said branches having a flat portion on an outside edge of a free end, said flat portions of said branches when aligned, form a single flat portion, parallel to said flat portion of said plate and enabling said display unit to be placed vertically on said support.

4. The display unit claimed in claim 2, wherein said surface is a material or has a color adapted to absorb light.

5. The display unit claimed in claim 4, wherein said color is matt black.

6. The display unit claimed in claim 1, wherein said branches are articulated to each other by means of a pivot, an axis of said pivot is perpendicular to a plane of articulation of said branches.

7. The display unit claimed in claim 6, wherein an end of each of said branches are nested one within the other, said nested ends of said branches having holes for mounting said nested ends on said pivot.

8. The display unit claimed in claim 7, wherein said pivot comprises a screw passing through said holes in said branches and screwed into a threaded bush.

9. The display unit claimed in claim 1, wherein said branches are substantially semicircular.

10. An eyeglass lens display unit comprising:

a first, generally flat, eyeglass lens holder with a semicircular interior surface arranged and adapted to hold a semicircular portion of a first eyeglass lens;

a second, generally flat, eyeglass lens holder with a semicircular interior surface arranged and adapted to hold a semicircular portion of a second eyeglass lens, said second lens holder being coplanar with said first lens holder;

a pivot connecting said first and second lens holders and permitting movement of said first and second lens holders between a first position in which the respective semicircular interior surfaces of said first and second lens holders are brought together and form a circle and a second position in which said first and second lens holders are spaced apart, said first and second lens holders being pivotally connected so that diameters of the semicircular portions of the first and second eyeglass lenses meet edge-to-edge when the respective lenses are held in said first and second lens holders and said first and second lens holders are in said first position; and a plate attached to said pivot, said plate being spaced from and parallel to said first and second lens holders, said plate having a light absorbing surface facing said first and second lens holders.

11. The display unit of claim 10, wherein said first and second lens holders and said plate each having a flat exterior peripheral portion opposite said pivot on which the display unit stands.

* * * * *